United States Patent [19]

Benton, Jr.

[11] 4,101,884

[45] Jul. 18, 1978

[54] VISUAL DISPLAY WITH MAGNETIC OVERLAY

[76] Inventor: Lawrence M. Benton, Jr., 1727 N. 34th St., Milwaukee, Wis. 53208

[21] Appl. No.: 765,354

[22] Filed: Feb. 3, 1977

[51] Int. Cl.[2] ..... G09F 7/04

[52] U.S. Cl. ..... 340/366 B; 340/381; 340/378 A; 40/621

[58] Field of Search ..... 340/366 B, 381, 378 A; 40/142 A, 133 R

[56] References Cited

U.S. PATENT DOCUMENTS

| | | | |
|---|---|---|---|
| 3,010,235 | 11/1961 | Roberts | 40/133 R |
| 3,666,936 | 5/1972 | Webster | 40/133 R |
| 3,928,921 | 12/1975 | Gurman | 40/142 A |
| 3,987,567 | 10/1976 | Fritts | 40/142 A |
| 3,988,845 | 11/1976 | Boatman | 40/142 A |

*Primary Examiner*—Harold I. Pitts

*Attorney, Agent, or Firm*—Andrus, Sceales, Starke & Sawall

[57] ABSTRACT

An imperforate display membrane is backlit by placing an apertured support between a light source and the display membrane so that light travels through the support and forms a spot on the membrane at a desired position having display indicia in registration therewith. One or more overlay members are provided and with said members having revised indicia thereon which either up-dates, corrects or otherwise revises the indicia on the original membrane. The membrane support and each overlay member are constructed to provide mutual magnetic attraction therebetween. Furthermore, each overlay member is provided with an opening which is adapted to register with the light aperture in the membrane support when the overlay member is magnetically held in place to the support and over the old indicia.

6 Claims, 4 Drawing Figures

VISUAL DISPLAY WITH MAGNETIC OVERLAY

BACKGROUND AND SUMMARY OF THE INVENTION

This invention relates to a visual display with magnetic overlay.

Visual displays have long been used in the areas of education, business training, selling and the like. Some such displays incorporate a replaceable display membrane which is removably mounted to a planular support. The support is provided with apertures through which light is passed to impinge on the membrane at a desired position. See the present inventor's pending U.S. patent application Ser. No. 604, 848 filed Aug. 14, 1975 and entitled "Visual Display With Backlighting", now U.S. Pat. No. 4,048,739.

Such display membranes are usually of a thin flexible transparent or translucent material, such as paper or film, and are provided with at least one, and usually a plurality, of display indicia thereon where registers with a light aperture in the support therebeneath.

In today's fast moving world, it has been found that one or more of the informational indicia on a display membrane may become obsolete almost before the ink is dry thereon. Thus, a membrane may become out of date quite quickly. Likewise, an error may be found in the indicia on a display membrane after the membrane is printed. The cost of frequently reprinting entire display membranes would be excessive.

The present invention is based on a solution to the problem of how to update or revise parts of a display membrane without having to replace the entire membrane.

In accordance with the invention, one or more overlay members are provided and with said members having revised indicia thereon which either updates, corrects or otherwise revises the indicia on the original membrane. The membrane support and each overlay member are constructed to provide mutual magnetic attraction therebetween. Furthermore, each overly member is provided with an opening which is adapted to register with the light aperture in the membrane support when the overlay member is magnetically held in place to the support and over the old indicia.

BRIEF DESCRIPTION OF THE DRAWINGS

The accompanying drawings furnished herewith illustrate the best mode presently contemplated by the inventor for carrying out the invention.

In the drawings.

DESCRIPTION OF THE PREFERRED EMBODIMENT

Figure 1:
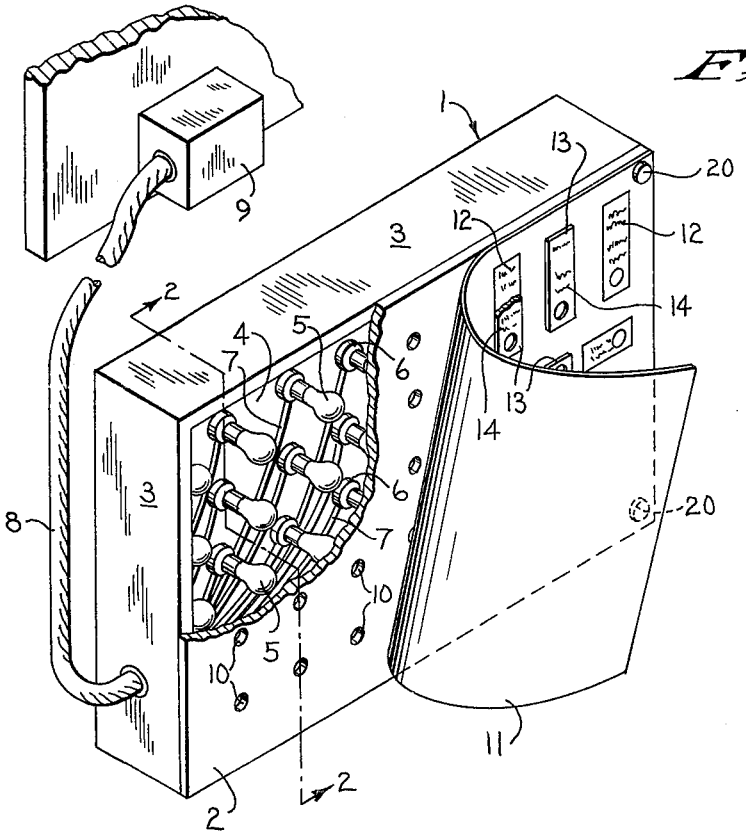
FIG. 1 is a front perspective view of a visual display device incorporating the concept of the invention and with the display membrane folded back for purposes of clarity.
Figure 2:
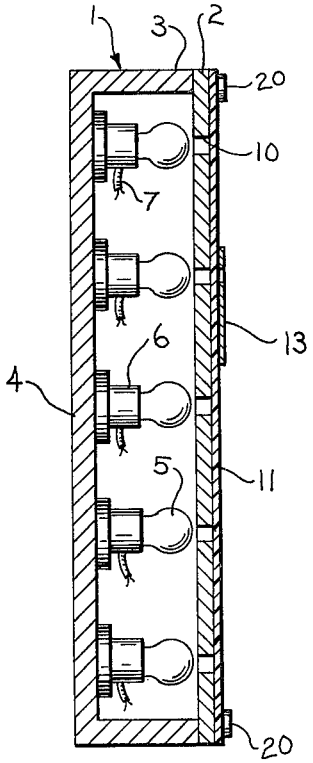
FIG. 2 is a transverse section taken on line 2—2 of FIG. 1.

As shown in the drawings, the invention is embodied in an enclosed frame-like box 1 having a planular front wall 2, peripheral edge walls 3 and a back wall 4.

The inner face of back wall 4 provides a mounting for a light source which is shown as a plurality of spaced forwardly facing light bulbs 5 mounted in suitable sockets 6 which in turn are connected through wires 7 to a collecting cable 8 and hence to a master control panel 9. Panel 9 may be of the type disclosed in my U.S. Pat. No. 3,726,033 wherein one or more bulbs may be selectively actuated at any given time.

Front wall 2 is provided with a plurality of apertures 10, with each aperture disposed directly forwardly of its respective bulb 5. Wall 2 forms a support for a planular visual display surface such as membrane 11 which is removably mounted thereto as will be hereinafter described. Membrane 11 is imperforate and co-extensive with its support and is light-transmissive. It may be made of paper, film or other suitable material.

A plurality of discrete spaced display indicia portions 12 are disposed on the front display face of membrane 11, with at least some of these portions registering with apertures 10.

When panel 9 is actuated to light various bulbs, the light rays emitted therefrom will pass through the adjacent aperture 10 and are collimated so as to produce a spot of light at the registered indicia 12 on membrane 11, By disposing front support wall 2 between bulbs 5 and membrane 11, the bulbs do not project forwardly of the display and no holes are necessary in the membrane.

As heretofore mentioned, one or more of the indicia 12 on membrane 11 may become obsolete or contain errors. For these and other reasons, it may be desirable to revise indicia 12 for the viewer without reprinting the entire membrane.

Figure 3:
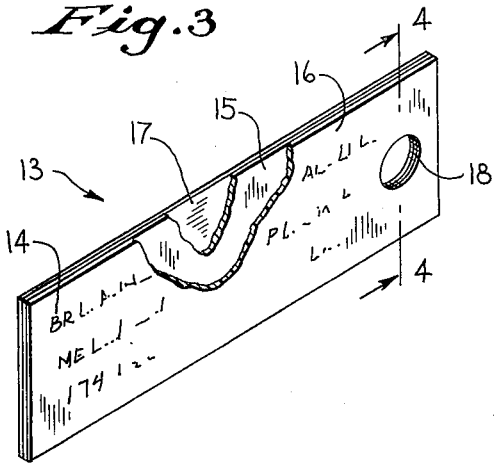
FIG. 3 is an enlarged perspective view of the overlay member having revised indicia thereon, and with parts broken away.
Figure 4:
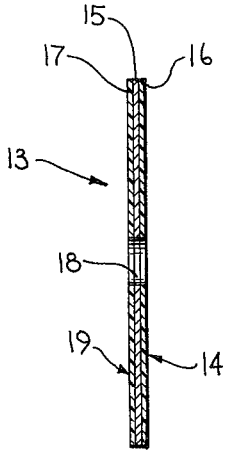
FIG. 4 is a transverse section of the overlay taken on line 4—4 of FIG. 3.

In accordance with the inventive concept and referring primarily to FIGS. 3 and 4, a removable wafer-like overlay member 13 is provided for covering each indicia 12 which is to be revised. Member 13 is generally of the same planular extent as the indicia 12 which it is to cover, and is provided with revised indicia 14 on its top surface which differs from indicia 12.

Means are provided to firmly hold overlay member 13 to the display panel with membrane 11 confined between the overlay and front support wall 2. For this purpose, overlay member 13 and wall 2 are constructed to be mutually magnetic attractive. As shown, member 13 is of laminated construction and includes a metallic core sheet 15 sandwiched between a front membrane sheet 16 and a rear membrane sheet 17. In addition, support wall 2 of the display box is metallic.

In the present embodiment, sheet 15 is magnetic in nature and wall 2 is of sheet steel or other metal capable of attracting a magnet. It is conceivable that wall 2 itself might be magnetic in nature and sheet 15 of sheet steel or other metal capable of being attracted to the magnetic wall, without departing from the spirit of the invention.

It is contemplated that overlay member 13 will cover old indicia 12 while still permitting the spot of light to be visible through the adjacent aperture 10, membrane 11 and overlay 13. For this purpose, an opening 18 is disposed in overlay member 13 for registry with an aperture 10. Opening 18 is positioned the same relative to revised indicia 14 as aperture 10 is positioned relative to the respective indicia 12 so that a complete registry of the new and old indicia occurs.

New indicia 14 is shown as being disposed on front sheet 16. If desired, indicia 19 may be disposed on the surface of rear sheet 17 for identifying the particular overlay.

Membrane 11 is held to support wall 2 in any suitable way, such as by magnets 20 at the corners, or by vacuum means as described in the inventor's aforementioned patent.

The invention provides a unique concept for selectively updating, correcting or otherwise revising indicia on a removable membrane in a visual display.

Various modes of carrying out the invention are contemplated as being within the scope of the following claims particularly pointing out and distinctly claiming the subject matter which is regarded as the invention.

I claim:

1. A visual display device comprising, in combination:

(a) a planular support wall having a plurality of apertures therein, (b) a light source disposed behind said support wall, (c) a removable flexible light transmissive imperforate membrane disposed on the front of said support wall, and with said membrane having a plurality of discrete spaced display indicia portions thereon, (d) said indicia portions being disposed over said apertures, (e) at least one planular overlay member adapted to be removably disposed over one of said indicia portions and with said overlay member having a revised indicia thereon different from said first-named indicia, (f) means for securing said overlay member in place so that said membrane is confined between said overlay member and said support wall, (g) and an opening in said overlay member and adapted to register with the respective aperture so that light passing through said aperture onto said membrane is visible through said overlay member.

2. The device of claim 1 in which said overlay member and said support wall are mutually magnetically attractive to thereby provide said securing means (f).

3. The device of claim 2 in which:

(a) said overlay member comprises a laminated wafer having a sheet of metallic material and a membrane-like surface sheet with the latter sheet having said revised indicia thereon, (b) said support wall is metallic, (c) and said first-named sheet is magnetic.

4. The device of claim 2 in which:

(a) said overlay member comprises a laminated wafer having a sheet of metallic material and a membrane-like surface sheet with the latter sheet having said revised indicia thereon, (b) at least a portion of said support wall being metallic and magnetic.

5. The device of claim 2 which includes means for securing said membrane to said support wall.

6. The device of claim 5 wherein:

(a) at least a portion of said support wall is metallic, (b) and said membrane securing means comprises magnets holding said membrane to said support wall.

* * * * *